US010273800B2

(12) United States Patent
Downie et al.

(10) Patent No.: US 10,273,800 B2
(45) Date of Patent: Apr. 30, 2019

(54) TURBINE DRILLING ASSEMBLY WITH NEAR DRILLING BIT SENSORS

(75) Inventors: Andrew M. Downie, Dunfermline (GB); Christopher P. Crampton, Alva (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 358 days.

(21) Appl. No.: 14/418,415

(22) PCT Filed: Aug. 21, 2012

(86) PCT No.: PCT/US2012/051743
§ 371 (c)(1),
(2), (4) Date: Jan. 29, 2015

(87) PCT Pub. No.: WO2014/031108
PCT Pub. Date: Feb. 27, 2014

(65) Prior Publication Data
US 2015/0184503 A1 Jul. 2, 2015

(51) Int. Cl.

| | |
|---|---|
| ***E21B 4/02*** | (2006.01) |
| ***E21B 7/04*** | (2006.01) |
| ***E21B 47/16*** | (2006.01) |
| ***E21B 47/024*** | (2006.01) |
| ***E21B 47/02*** | (2006.01) |
| ***E21B 47/12*** | (2012.01) |

(52) U.S. Cl.
CPC ..... *E21B 47/024* (2013.01); *E21B 4/02* (2013.01); *E21B 47/02* (2013.01); *E21B 47/12* (2013.01)

(58) Field of Classification Search
CPC ..... E21B 4/02; E21B 7/04; E21B 7/06; E21B 7/068; E21B 47/12; E21B 47/14; E21B 47/16
USPC ..... 175/61, 40, 45
See application file for complete search history.

(56) References Cited

U.S. PATENT DOCUMENTS

| | | | | |
|---|---|---|---|---|
| 3,637,032 | A | 1/1972 | Jeter | |
| 4,196,781 | A * | 4/1980 | Cheek | E21B 7/04 175/321 |
| 5,160,925 | A | 11/1992 | Dailey et al. | |
| 5,163,521 | A | 11/1992 | Pustanyk et al. | |
| 5,410,303 | A | 4/1995 | Comeau et al. | |
| 5,592,381 | A | 1/1997 | Henneuse et al. | |

(Continued)

FOREIGN PATENT DOCUMENTS

JP 3487850 10/2003

OTHER PUBLICATIONS

International Search Report of PCT Application No. PCT/US2012/051743 dated Mar. 27, 2013: pp. 1-4.

(Continued)

*Primary Examiner* — Kenneth L Thompson
(74) *Attorney, Agent, or Firm* — Chamberlain Hrdlicka

(57) ABSTRACT

A turbine drilling assembly can include a turbine drilling motor having an upper drill string connector, and an inclination sensor positioned in the turbine drilling assembly below the upper drill string connector. Another turbine drilling assembly can include a turbine drilling motor having an upper drill string connector, a sensor positioned in the turbine drilling assembly below the upper drill string connector, and a transmitter which transmits sensor data through a housing of the turbine drilling motor.

11 Claims, 10 Drawing Sheets

(56) References Cited

U.S. PATENT DOCUMENTS 5,817,937 A * 10/1998 Beshoory ..... E21B 47/011 73/152.46
5,881,310 A 3/1999 Airhart et al.
6,176,323 B1 1/2001 Weirich et al.
6,206,108 B1 3/2001 MacDonald et al.
6,328,119 B1 * 12/2001 Gillis ..... E21B 7/062 175/325.1
6,571,888 B2 * 6/2003 Comeau ..... E21B 4/02 175/107
6,714,870 B1 * 3/2004 Weston ..... E21B 47/022 702/6
7,084,782 B2 * 8/2006 Davies ..... E21B 4/02 175/26
7,743,654 B2 * 6/2010 Spross ..... E21B 7/067 73/152.03
7,755,361 B2 * 7/2010 Seydoux ..... G01V 3/28 324/333
8,887,834 B2 * 11/2014 Millet ..... E21B 7/067 175/61
9,523,263 B2 * 12/2016 Downie ..... E21B 41/0085
2001/0045300 A1 * 11/2001 Fincher ..... E21B 7/068 175/26
2005/0000733 A1 * 1/2005 Schaaf ..... E21B 3/02 175/61
2009/0302851 A1 12/2009 Bittar et al.
2013/0319764 A1 * 12/2013 Schaaf ..... E21B 7/06 175/24

OTHER PUBLICATIONS

Anonymous, "GABI Gamma/At-Bit Inclination Sensor Providing At-Bit Azimuthal Gamma Ray and Inclination Measurements for Improved Geosteering and Optimum Well Placement," Halliburton Sperry Drilling, Brochure H05723, Feb. 2012: pp. 1-2.
Anonymous, "Imaging Solutions for Formation Evaluation," Halliburton, Poster H07225, Sep. 2009: p. 1.

* cited by examiner

TURBINE DRILLING ASSEMBLY WITH NEAR DRILLING BIT SENSORS

TECHNICAL FIELD

This disclosure relates generally to equipment utilized and operations performed in conjunction with subterranean well drilling and, in one example described below, more particularly provides a turbine drilling assembly with sensors near a drill bit.

BACKGROUND

Sensors are used in drilling bottom hole assemblies (BHA's) for various purposes. However, such sensors are typically located a significant distance from a drill bit used to drill a wellbore, and so the sensors are of limited usefulness, for example, in "geo-steering" the drill bit.

Therefore, it will be appreciated that improvements are continually needed in the art of constructing drilling BHA's. Such improvements may be useful in geo-steering, or in other drilling operations.

DETAILED DESCRIPTION

Figure 1:
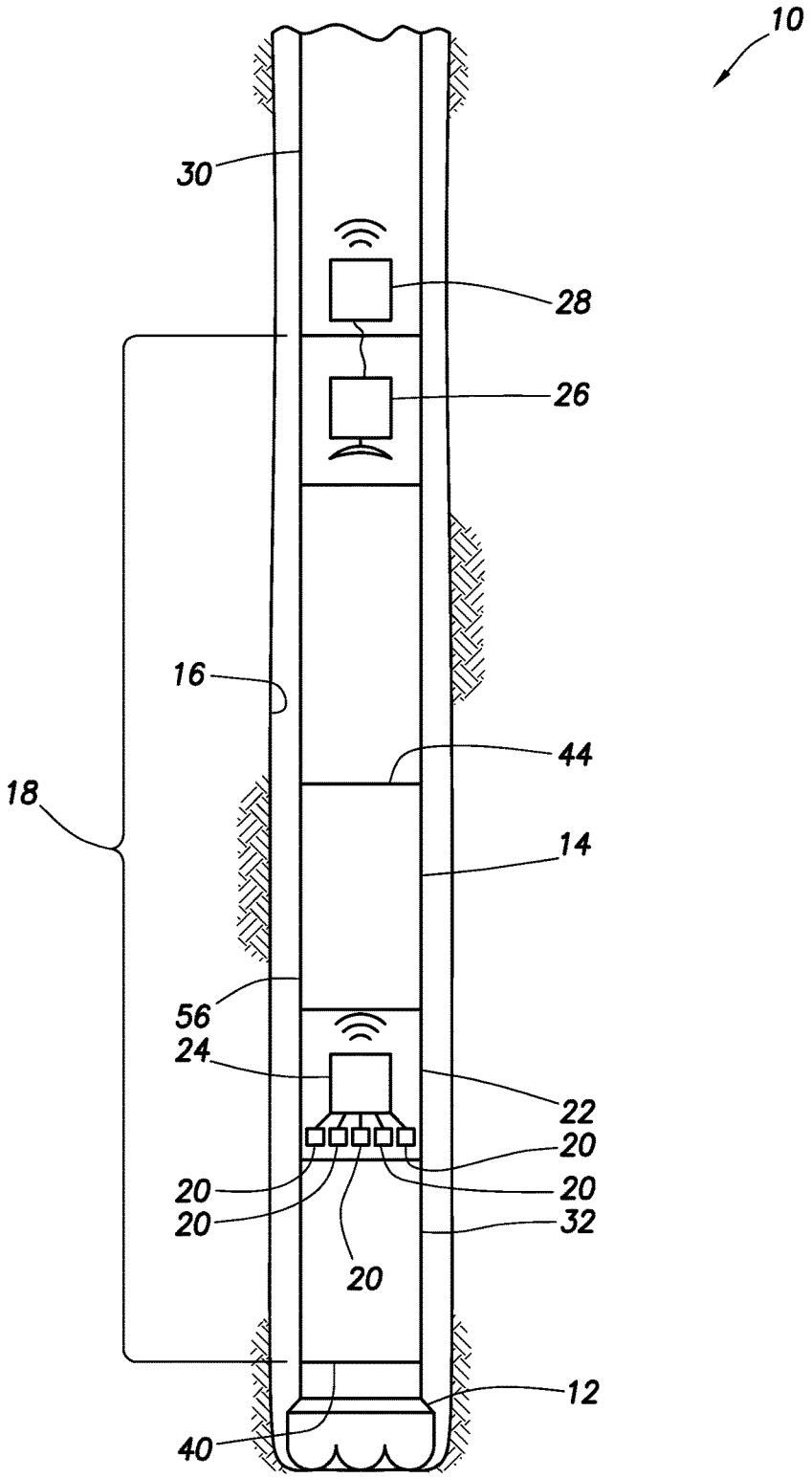
FIG. 1 is a representative partially cross-sectional view of a well drilling system and associated method which can embody principles of this disclosure.

Representatively illustrated in FIG. 1 is a well drilling system 10 and an associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As described more fully below, the system 10 allows for measurement of downhole drilling parameters closer to a drill bit 12 than was previously available when drilling with a turbine drilling motor 14. Preferably, inclination of a turbine drilling assembly 18 being used to drill a wellbore 16 is measured relatively close to the bit 12, but other parameters (such as, torque, rotational speed (RPM), pressure, gamma ray and/or resistivity, etc.) may also be measured, if desired.

In conventional directional drilling technology, an inclination and azimuthal direction of a wellbore are measured by means of various types of sensors, well known in the art, that are normally housed within a measurement-while-drilling (MWD) and/or logging-while-drilling (LWD) tool, which forms part of a drilling bottom hole assembly (BHA). An objective of these measurements is to ensure that the wellbore is drilled along its intended path and reaches a target point within an acceptable tolerance.

In a BHA with a drilling motor, the MWD/LWD tool is placed above the motor, and often by a significant distance, usually because of requirements for magnetic spacing, and/or the need to position other downhole sensor packages below the directional sensors. Consequently, particularly in a BHA including a turbine drilling motor, the directional sensors can be more than 30 meters behind the bit in some cases.

In certain applications, such as when drilling and landing a build section of a well, or in horizontal wells with a restricted vertical tolerance, having directional sensors so far away from the bit is a serious disadvantage, and in some cases precludes the use of a turbine drilling motor. The ability to position these sensors much closer to the bit (for example, within at least eight meters, but preferably one to four meters) allows a directional driller to have much better control of the wellbore position, and allows faster decisions to be made when correcting the wellbore trajectory.

For example, when making a correction to the wellbore inclination, the directional driller aligns a deviating device (such as, a bent housing) in the BHA and slide drills in a desired direction. Positioning the inclination sensor closer to the bit allows the sensor to enter the newly drilled wellbore sooner and, hence, indicates to the driller much earlier that the newly drilled wellbore is proceeding in the desired direction.

This also applies to other wellbore related sensors (such as, azimuth and gamma ray sensors). The sooner the sensor enters the newly drilled wellbore, the earlier the driller can react and make adjustments, if necessary.

The following description relates in large part to use of an inclination sensor in the turbine drilling assembly 18. However, it should be clearly understood that other sensors (such as, weight on bit, torque, RPM, vibration, stick-slip, gamma radiation, resistivity, azimuth, etc.) could be included, if desired. The incorporation of sensors into the turbine drilling assembly 18 also allows for measurement of operating parameters of the turbine drilling motor 14 (such as, torque, RPM, pressure, etc.) downhole in real time. The ability to measure and transmit this data to an operator or driller enables optimization of the turbine operating parameters and drilling performance.

In the past, turbine drilling motors were controlled by the driller using surface indications, which are of limited accuracy. Real time downhole measurements will provide a much clearer indication of actual downhole operating conditions, allowing the drilling process to be optimized, either manually or by means of a computerized feedback system. Also, a condition of the turbine drilling motor 14 can be monitored over time and, if necessary, corrective action can be taken sooner, thereby avoiding potentially costly downhole failures.

Suitable sensors for use in the turbine drilling assembly 18 include those presently marketed by Halliburton Energy Services, Inc. of Houston, Tex. USA as part of their GEO-PILOT™ ABI/GABI™ directional drilling tools. These sensors include inclination and gamma ray sensors, which are mounted in a positive displacement (Moineau-type) drilling motor BHA.

In contrast, the present specification describes use of sensors 20 in the turbine drilling assembly 18, which presents different challenges for positioning the sensors and transmitting data from the sensors to a remote location (such as, the earth's surface, a sea floor facility, etc.). In the FIG. 1 example, the sensors 20 are positioned in a bent housing 22 connected between the turbine drilling motor 14 and a bearing assembly 32 containing bearings which rotationally support a shaft (not visible in FIG. 1) rotated by the turbine drilling motor 14.

The sensors 20 are connected to a transmitter 24, which wirelessly transmits the sensor data to a receiver 26 positioned above the turbine drilling motor 14. In some examples described below, the sensor data is transmitted through a housing of the turbine drilling motor 14 acoustically via stress waves (preferably shear waves, but compression waves may be used in other examples). However, any form of telemetry, including wired or wireless (e.g., mud pulse, electromagnetic, acoustic, etc.) may be used as desired.

In the FIG. 1 example, the receiver 26 is connected to a transmitter 28 of an MWD tool 30. The transmitter 28 can transmit the sensor 20 data to a remote location using various forms of wired or wireless telemetry.

In some examples, the sensors 20 can be placed between the bearing assembly 32 and the turbine drilling motor 14 in such a way that the bearings and the sensors can be readily changed out on a rig floor. This allows the bearing assembly 32 and sensors 20 to be removed for maintenance purposes, whilst allowing a new sensor unit and bearing section to be conveniently retrofitted in the turbine drilling assembly 18 and, thereby, allowing drilling to proceed without being delayed by a need to service the replaced sensor unit and bearing section.

In some examples, the sensor unit (including the sensors 20) can be configured to be removed completely from the turbine drilling assembly 18 on the rig floor, thereby allowing it to be removed for short term maintenance without a need to replace the complete bearing section. This arrangement allows the sensor unit to be removed (to replace batteries, for example), and allows the turbine drilling motor 14 and bearing assembly 32 (and bearings therein) to be retrofitted with a replacement sensor unit.

In some examples, the sensors 20 are positioned above the bearing assembly 32 and the bent housing 22, but below the turbine drilling motor 14. In other examples, the sensors 20 are positioned below the bent housing 22, such that a lower mandrel of the bearing assembly 32 serves as a housing for the sensors 20, transmitter 24, electronics and batteries. This arrangement allows the sensors 20 to be positioned closer to the bit 12.

In this example, the components can be mounted in two half annular collars (e.g., "clam shells") that are fitted in a groove in the lower mandrel, and covered by a pressure retaining sleeve or sleeve stabilizer. Preferably, a chamber containing the electrical components is protected from ambient fluids and pressures, hence the use of a pressure retaining sleeve to seal off this chamber.

In a further example, the sensors 20 are positioned above the bent housing 22, but the bearing assembly 32 is positioned below the bent housing. This arrangement allows the sensors 20 to be positioned closer to the bit 12, whilst overcoming the physical space limitations associated with the clam shell arrangement mentioned above.

Figure 2A:
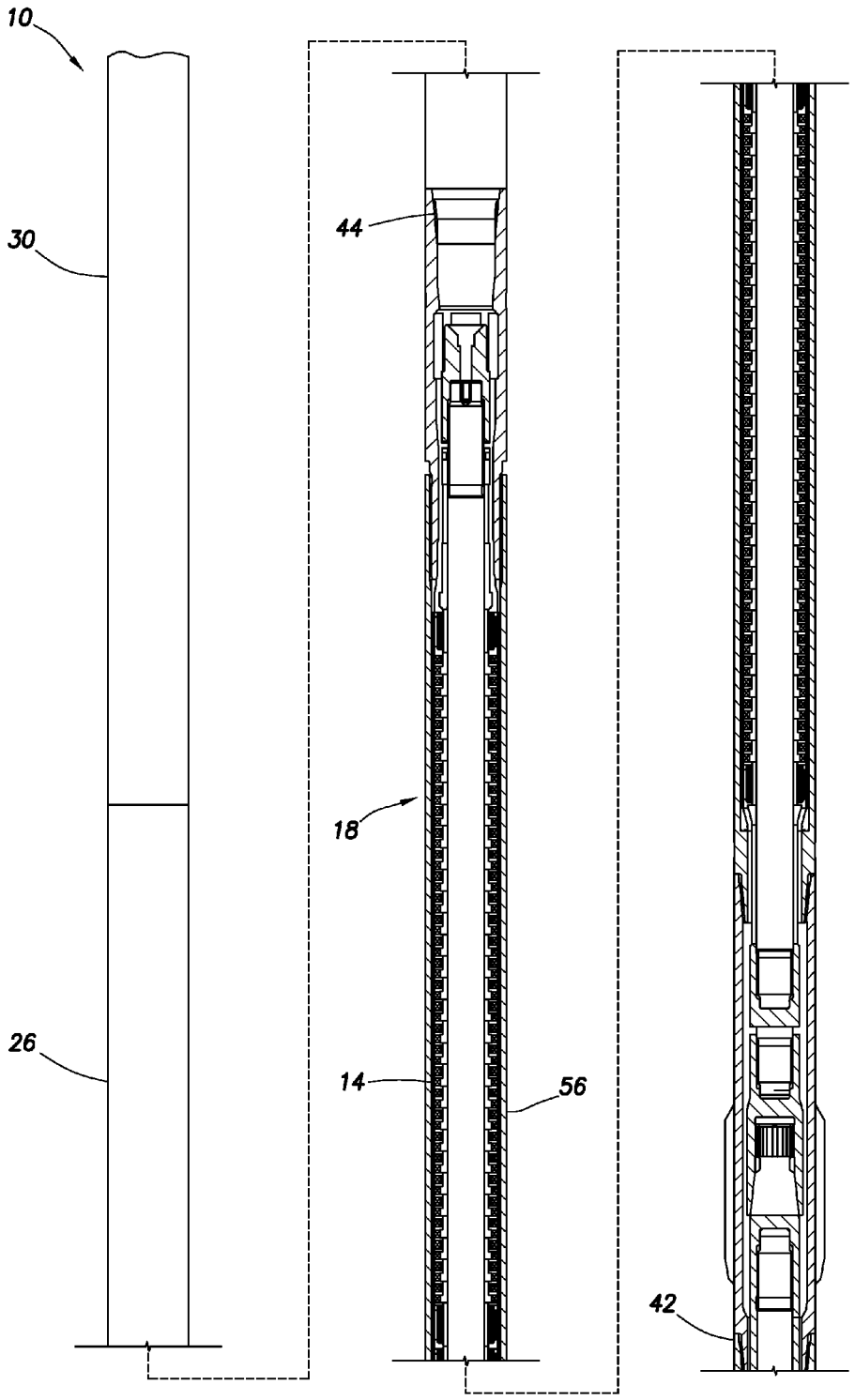
FIGS. 2A & B are representative cross-sectional views of a turbine drilling assembly which may be used in the system and method of FIG. 1, and which can embody the principles of this disclosure.

Referring additionally now to FIGS. 2A & B, a more detailed view of another example of the turbine drilling assembly 18 is representatively illustrated. As depicted in FIGS. 2A & B, a sensor housing 34 (containing, e.g., the sensors 20, electronics, transmitter 24 and batteries) is connected between the bearing assembly 32 and the turbine drilling motor 14. The bearing assembly 32 is positioned above the bent housing 22 in this example, but in other examples, the bearing assembly could be positioned below the bent housing.

The bearing assembly 32 includes bearings 36 which radially and axially support a shaft 38 rotated by the turbine drilling motor 14. The shaft 38 extends from the turbine drilling motor 14 to a lower drill bit connector 40 for rotating the drill bit 12 (not shown in FIGS. 2A & B). The connector 40 may comprise a pin (a male threaded connector), a box (a female threaded connector), or another type of drill bit connector.

The turbine drilling motor 14 is connected to the receiver 26 (and the remainder of a drill string above the receiver) by means of a drill string connector 44. In each of the examples described herein, the sensors 20 are positioned below the drill string connector 44 in the turbine drilling assembly 18.

In the FIGS. 2A & B example, the sensor housing 34 and bearing assembly 32 are conveniently separable from the remainder of the turbine drilling assembly 18, for example, at a separable shaft coupling 42. In this manner, the sensors 20 and/or bearings 36 can be serviced while drilling resumes with another sensor housing 34 and bearing assembly 32 in the turbine drilling assembly 18.

Figure 3A:
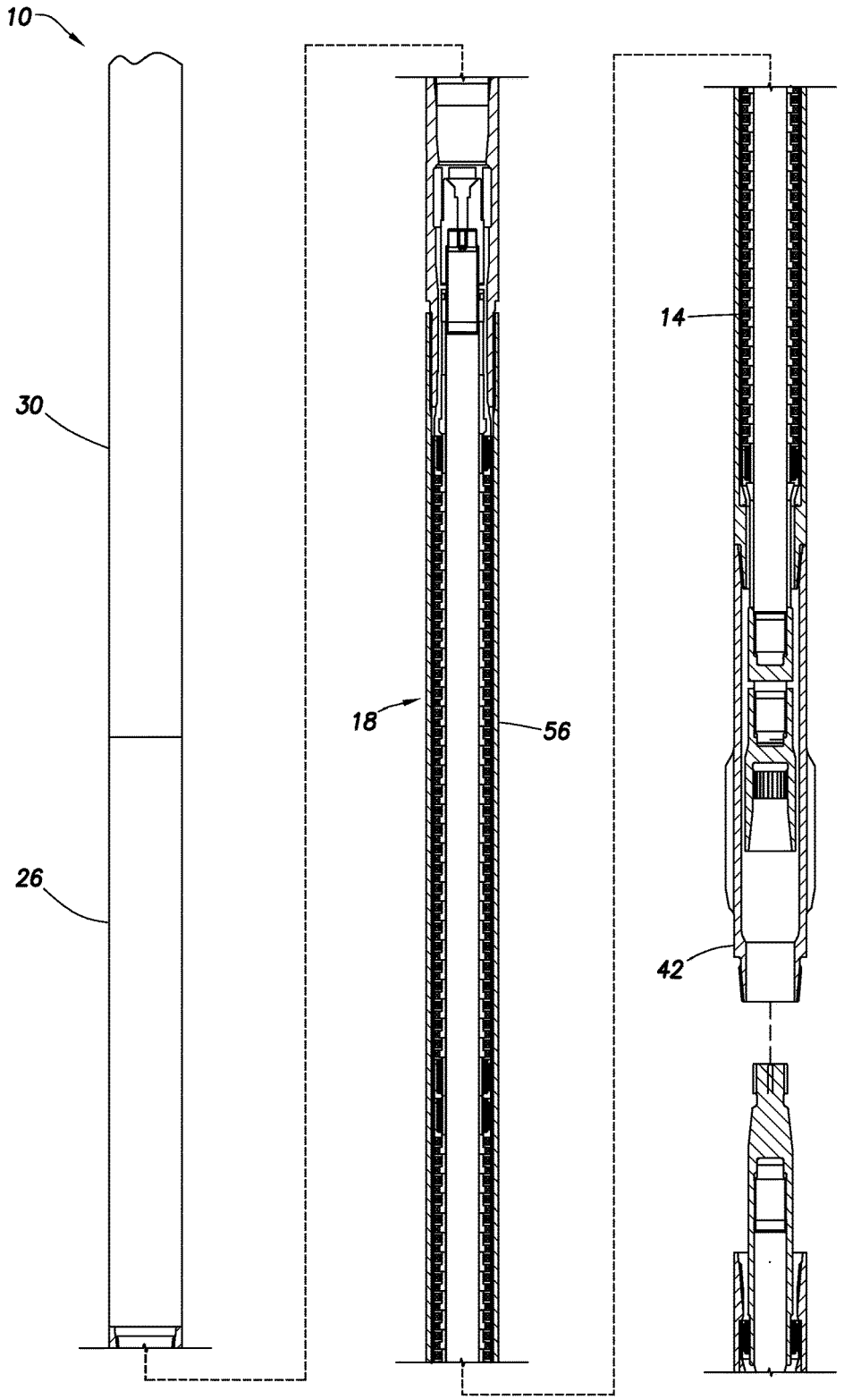
FIGS. 3A & B are representative cross-sectional views of another example of the turbine drilling assembly.

Referring additionally now to FIGS. 3A & B, another example of the turbine drilling assembly 18 is representatively illustrated. This example differs from the FIGS. 2A & B example, in that the sensor housing 34 is conveniently separable from both the turbine drilling motor 14 and the bearing assembly 32.

Thus, on a rig floor, the sensor housing 34 can be readily removed from the turbine drilling assembly 18 and replaced by another sensor housing, or batteries in the sensor housing can be quickly replaced, and drilling can resume without significant delay.

Figure 4A:
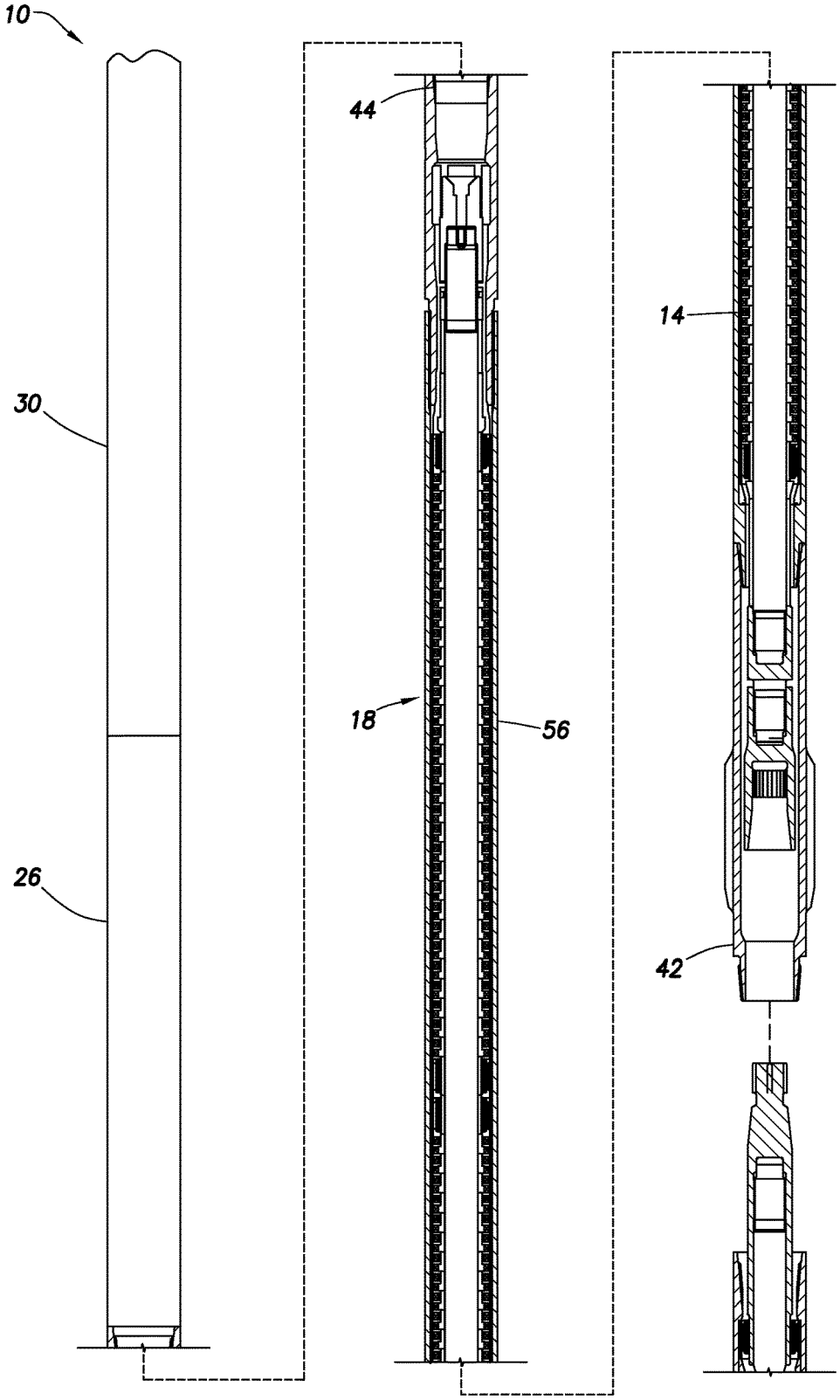
FIGS. 4A & B are representative cross-sectional views of another example of the turbine drilling assembly.

Referring additionally now to FIGS. 4A & B, another example of the turbine drilling assembly 18 is representatively illustrated. This example differs from the FIGS. 2A & B example, in that the bearing assembly 32 is positioned below the bent housing 22. More specifically, the bearings 36 in the bearing assembly 32 below the bent housing 22 can include thrust bearings to react axial loads imparted to the shaft 38.

Figure 2B:
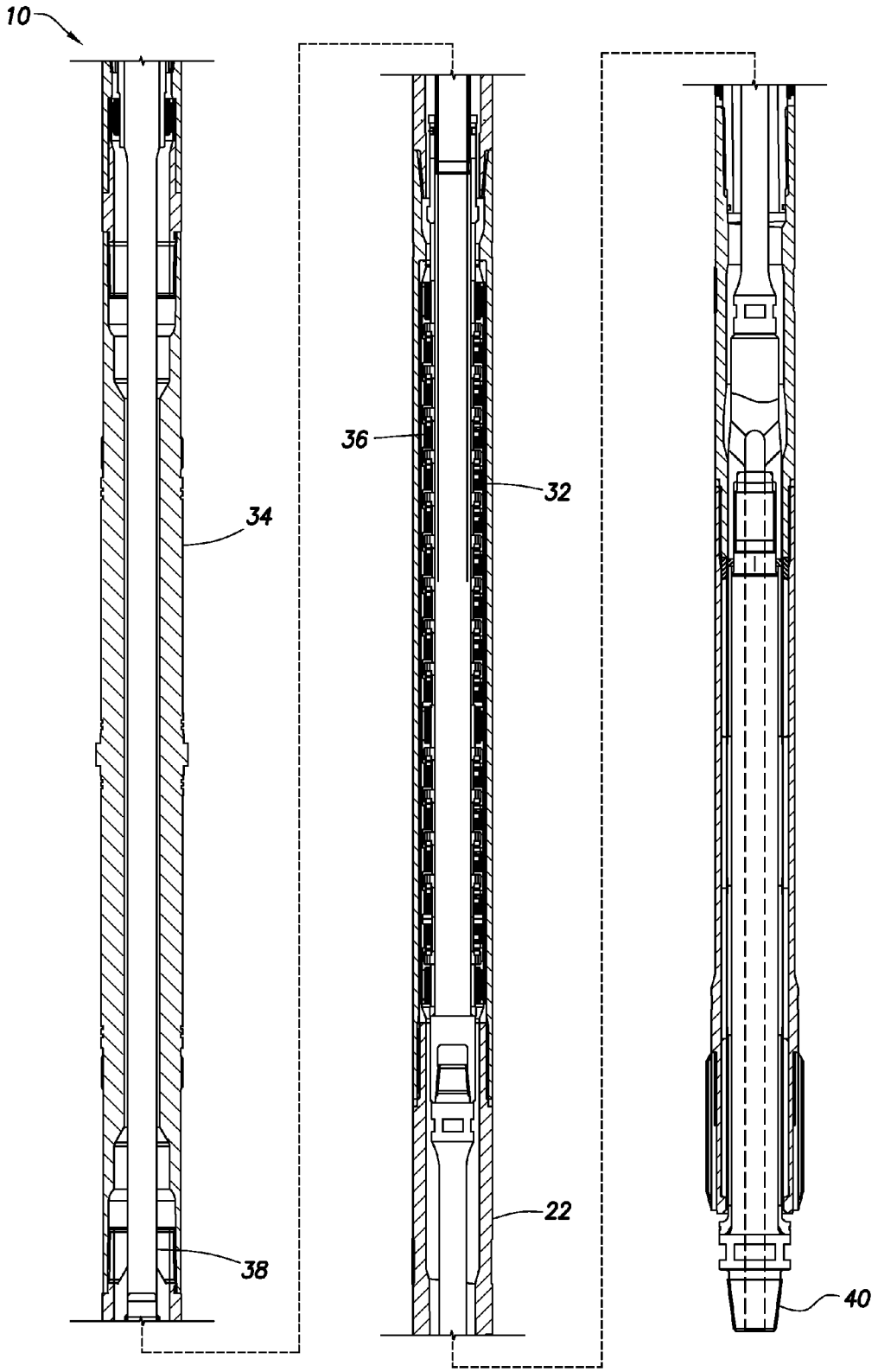
Figure 3B:
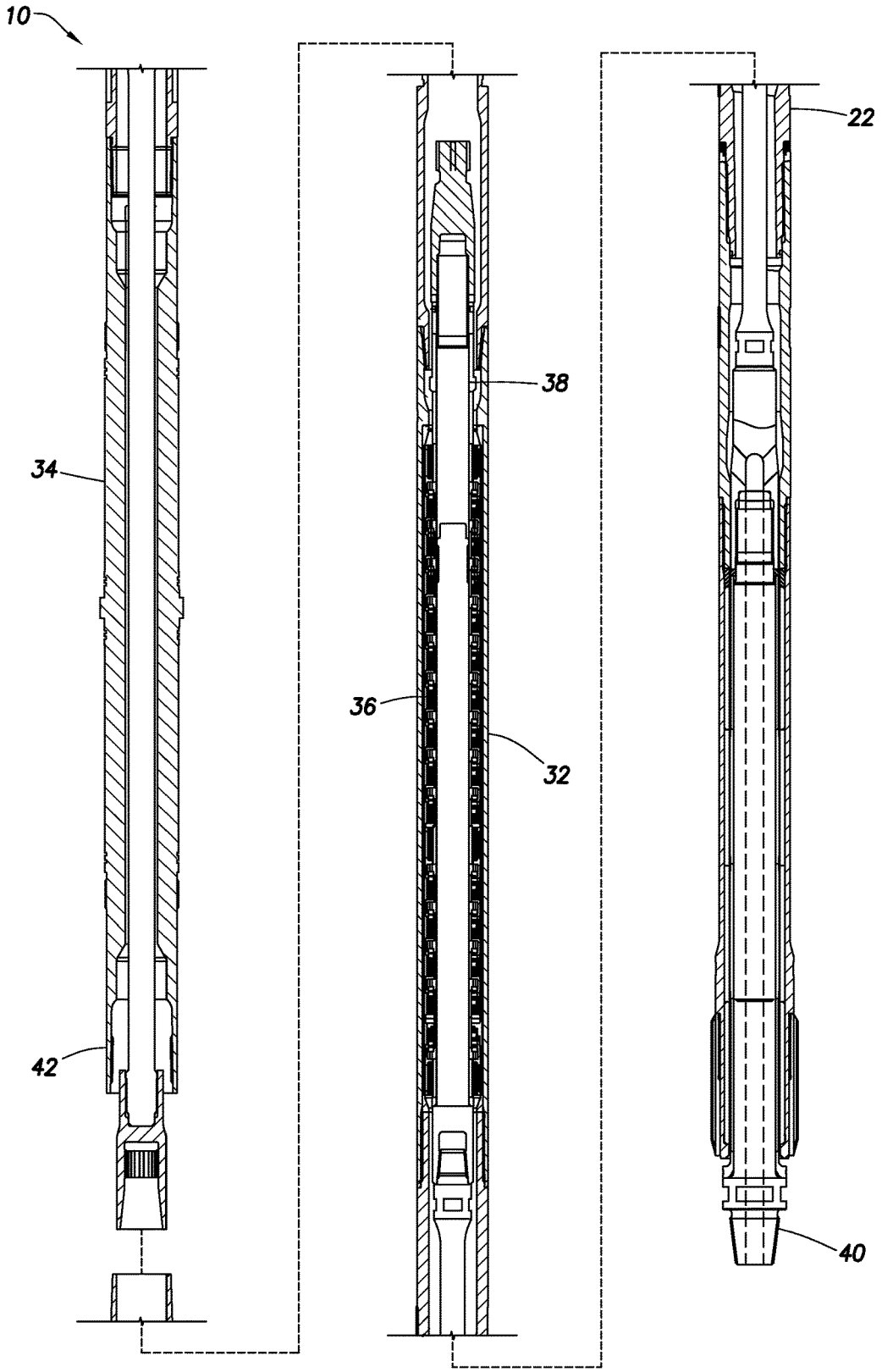
Figure 4B:
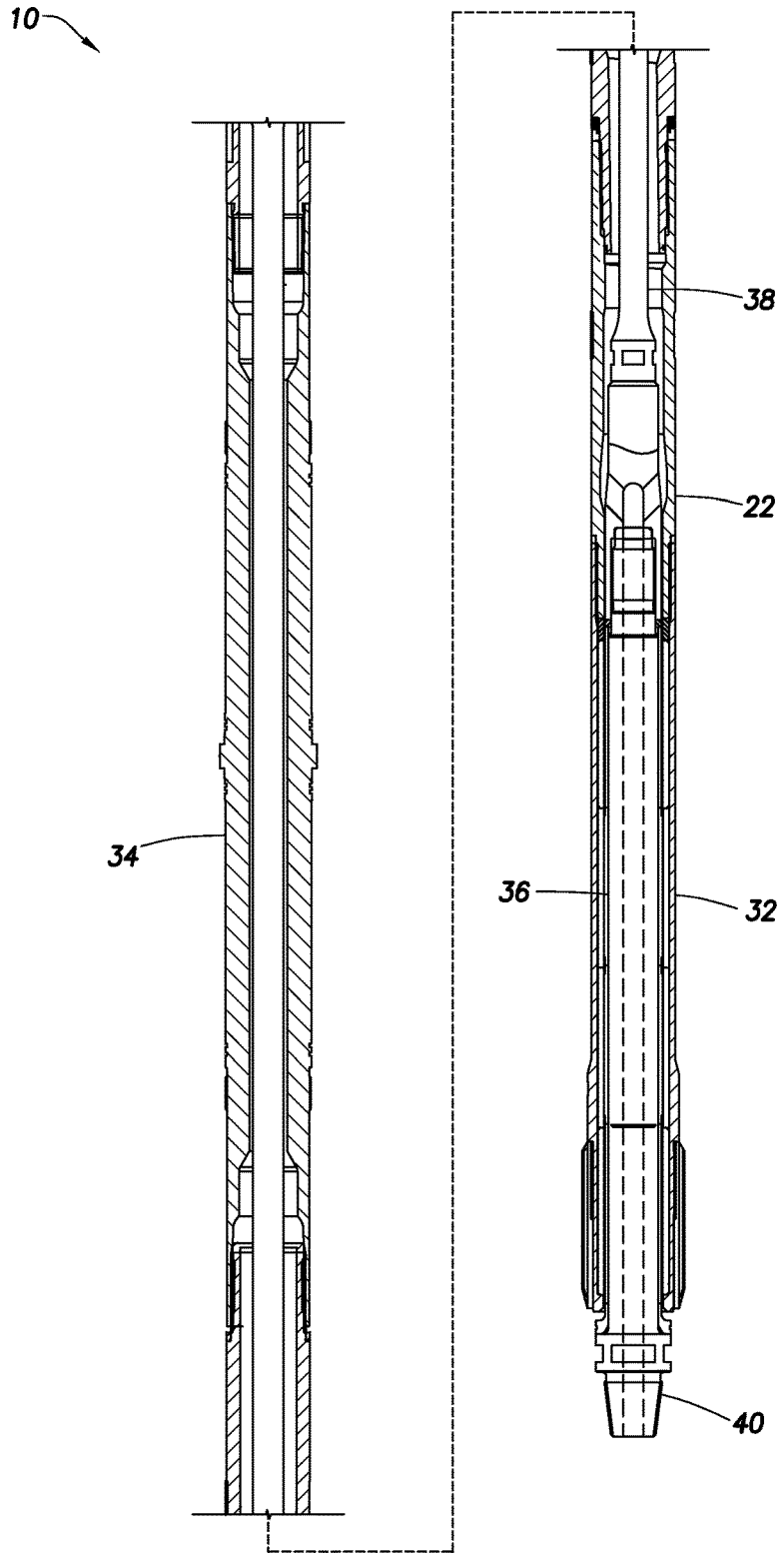
Figure 5:
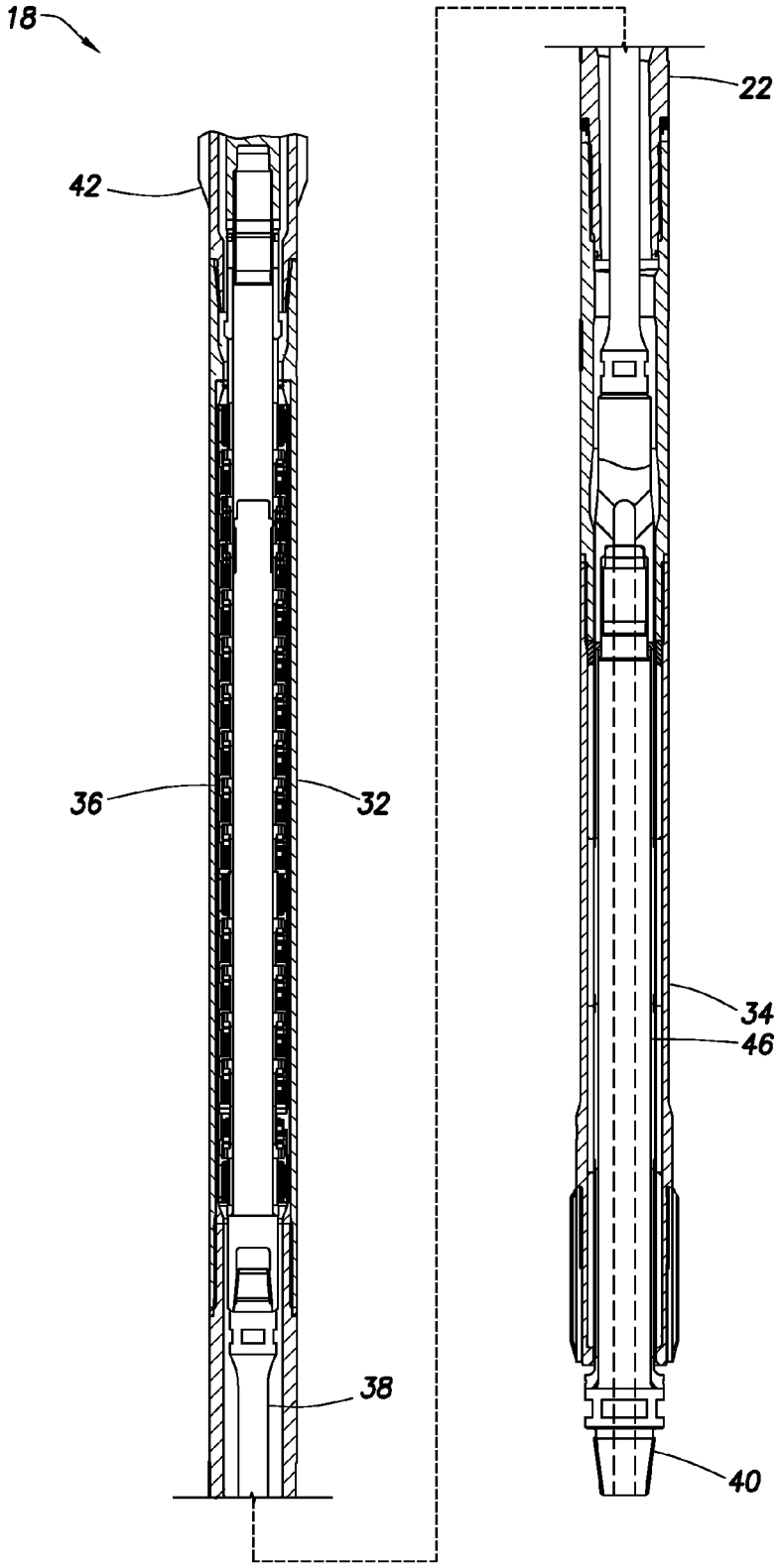
FIG. 5 is a representative cross-sectional view of another example of the turbine drilling assembly.

Referring additionally now to FIG. 5, another example of the turbine drilling assembly 18 is representatively illustrated. As in the FIGS. 2-4 examples described above, the turbine drilling motor 14 is connected above the separable shaft coupling 42, but the turbine drilling motor is not depicted in FIG. 5.

In this view, it may be seen that the sensor housing 34 is positioned below the bent housing 22. The sensors 20 (and associated electronics, batteries and transmitter 24) are contained in a recess formed on a mandrel 46 extending downwardly from the bearing assembly 32. In other examples, the sensors 20 could be positioned on the mandrel 46 in the bearing assembly 32 itself, whether the bearing assembly is positioned above or below the bent housing 22.

Figure 6:
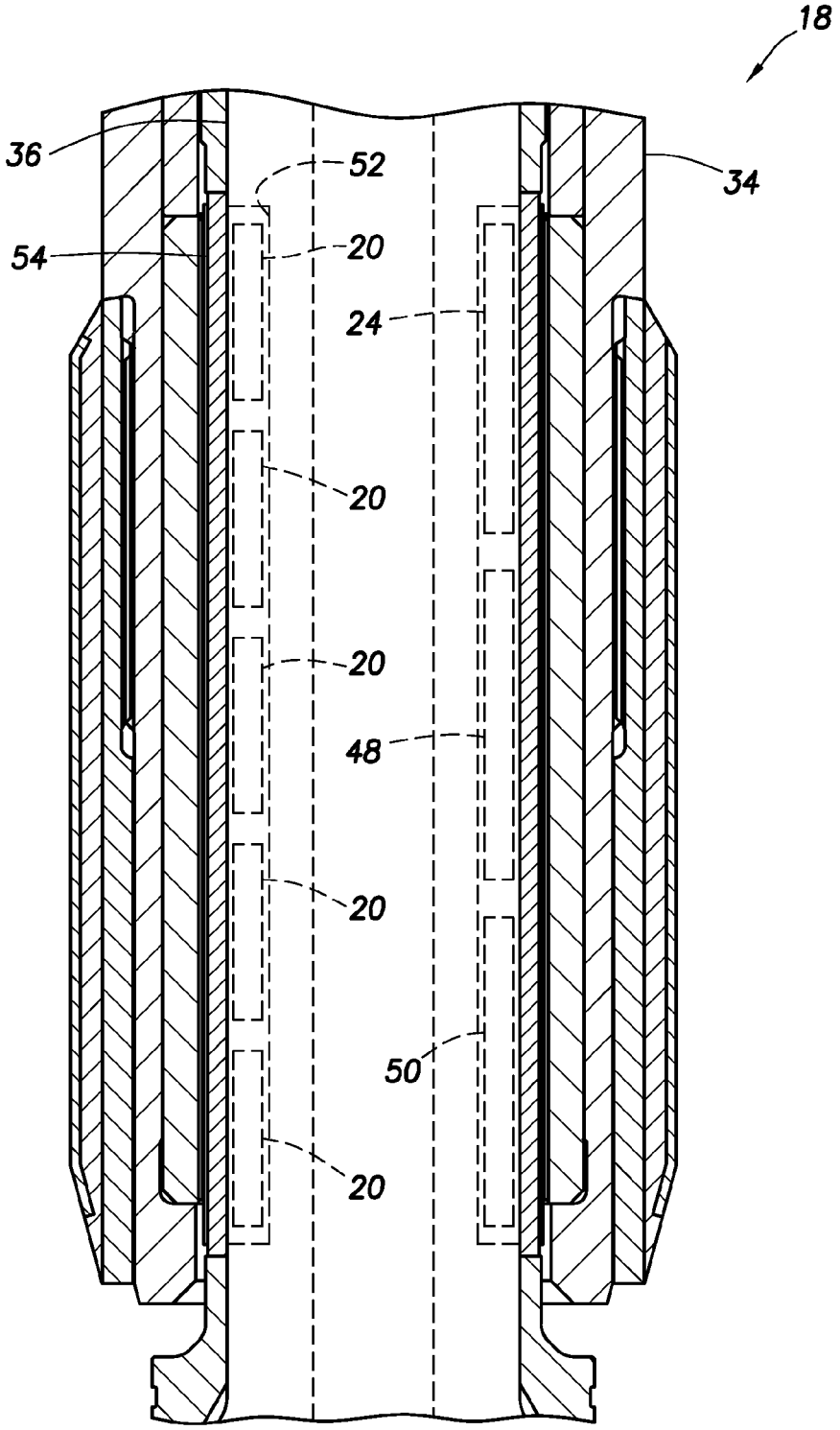
FIG. 6 is a representative cross-sectional view of a bearing assembly of the turbine drilling assembly.

Representatively illustrated in FIG. 6 is an enlarged scale view of the sensor housing 34 with the mandrel 36 therein. The sensors 20, electronics 48, batteries 50 and transmitter 24 are contained in a recess 52 formed on the mandrel 36.

The electrical components could be arranged, for example, in a clamshell-type configuration. A protective sleeve 54 is secured over the recess 52, in order to isolate the components therein from well fluids and pressures.

Figure 7:
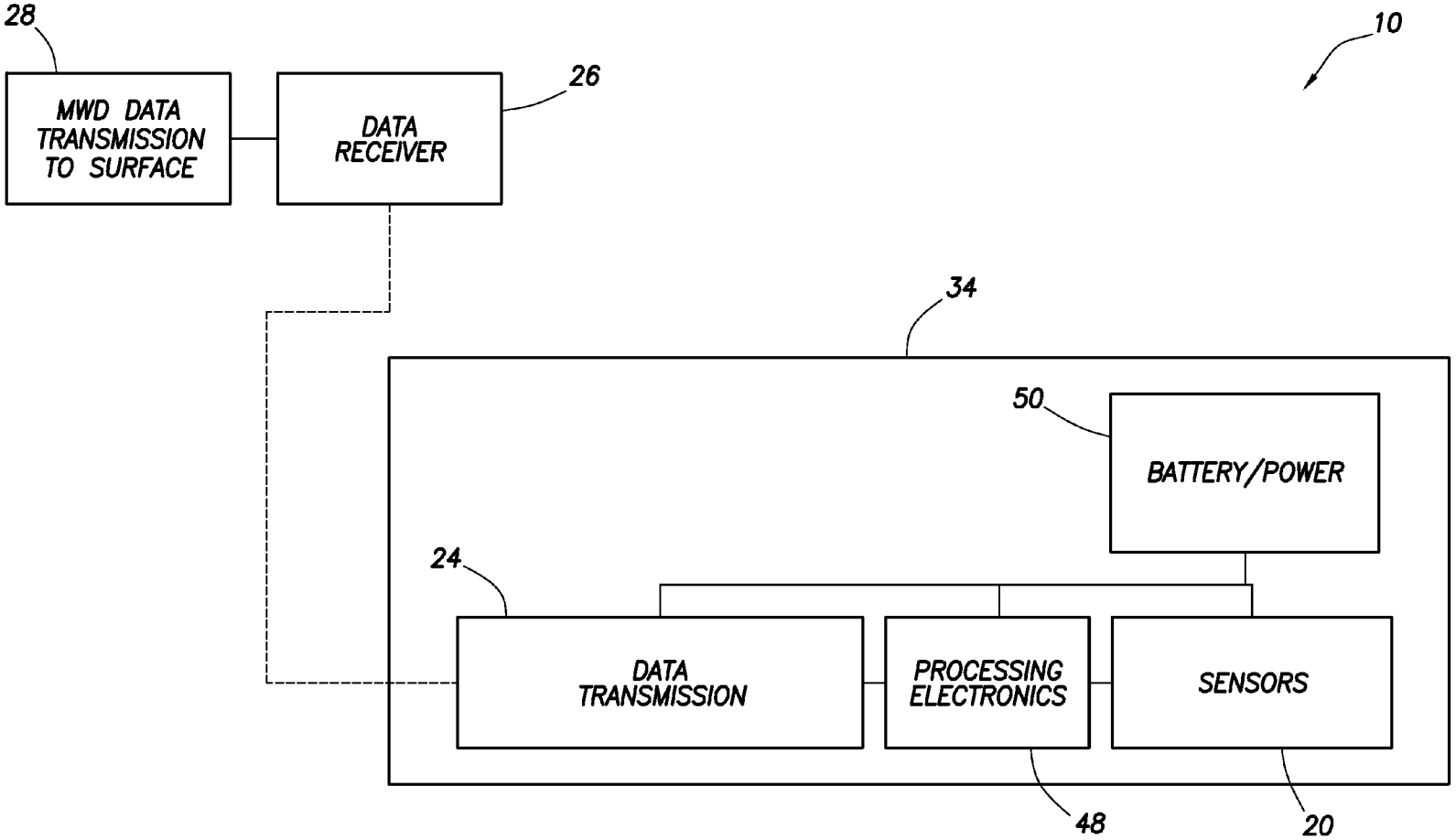
FIG. 7 is a representative schematic view of a sensor data transmission technique which can embody principles of this disclosure.

Referring additionally now to FIG. 7, a schematic view of the system 10 is representatively illustrated. FIG. 7 depicts a technique for acquiring and transmitting sensor 20 data, but this technique can be used with other systems and methods, if desired.

Preferably, the sensor housing 34 contains batteries 50 to power the system, but other electrical power sources (e.g., a downhole generator) may be used in other examples. The sensors 20 measure certain parameters. The processing electronics 48 convert the sensor 20 measurements into a transmissible format. The transmitter 24 transmits the data to the receiver 26.

The transmitter 24 and receiver 26 are preferably on opposite sides of the turbine drilling motor 14. In some examples, the data transmission is by means of an acoustic stress wave transmission method, of the type known to those skilled in the art, but other known short hop transmission methods could be used.

Measurements from the sensors 20 are received by the electronics 48 and, after conversion to a suitable format, the data is passed to the transmitter 24, which generates a stress wave in an outer structure of the turbine drilling assembly 18. For example, the stress wave can be transmitted through an outer housing 56 (see FIGS. 1-4) of the turbine drilling motor 14.

A frequency of the stress wave can be adjusted to maximize a signal amplitude that is received by the receiver 26 situated above the turbine drilling motor 14. The receiver 26 is electrically connected to the MWD tool 30. Data is passed from the receiver 26 to the MWD transmitter 28 for transmission to the surface, for example, by means of pressure pulses.

Turbine drilling motors have different operating speeds and structural differences as compared to positive displacement motors, and so the transmission of stress waves through the turbine drilling motor 14 outer housing 56 will benefit from use of frequencies that are tailored to these differences. The present inventors have determined that a range of frequencies from 500 Hz to 3000 Hz is suitable for transmitting stress waves through the turbine drilling motor 14. More preferably, the frequency range is from 1300 Hz to 1500 Hz.

It may now be fully appreciated that the above disclosure provides significant advances to the art of constructing and operating turbine drilling assemblies. In examples described above, the sensors 20 are positioned relatively close to the drill bit 12 for measurement of parameters in the newly drilled wellbore 16. In addition, data from the sensors 20 is transmitted through the turbine drilling motor 14.

A turbine drilling assembly 18 is described above. In one example, the turbine drilling assembly 18 can include a turbine drilling motor 14 having an upper drill string connector 44, and an inclination sensor 20 positioned in the turbine drilling assembly 18 below the upper drill string connector 44.

The inclination sensor 20 may be positioned between: a) bearings 36 which rotatably support a shaft 38 rotated by the turbine drilling motor 14, and b) a bent housing 22 of the turbine drilling assembly 18.

The inclination sensor 20 may be positioned between the turbine drilling motor 14 and both of: a) bearings 36 which rotatably support a shaft 38 rotated by the turbine drilling motor 14, and b) a bent housing 22 of the turbine drilling assembly 18.

The inclination sensor 20 may be positioned between a bent housing 22 and a lower drill bit connector 40 of the turbine drilling assembly 18.

The inclination sensor 20 may be housed in a bearing assembly 32 which rotatably supports a shaft 38 rotated by the turbine drilling motor 14. The inclination sensor 20 may be mounted to an internal mandrel 46 of the bearing assembly 32.

A bent housing 22 may be positioned between the inclination sensor 20 and bearings 36 which rotatably support a shaft 38 rotated by the turbine drilling motor 14.

The turbine drilling assembly 18 can include a first transmitter 24 which transmits inclination data through a housing 56 of the turbine drilling motor 14. The transmitter 24 may transmit the inclination data at approximately 500 to 3000 Hz through the turbine drilling motor housing 56. The transmitter 24 may transmit the inclination data at approximately 1300 to 1500 Hz through the turbine drilling motor housing 56.

The turbine drilling motor 14 may be connected between the first transmitter 24 and a receiver 26. The receiver 26 may be connected to a second transmitter 28 which transmits the inclination data to a remote location. The first transmitter 24 may modulate the inclination data on stress waves transmitted through the turbine drilling motor housing 56.

The turbine drilling assembly 18 can also include a gamma radiation sensor 20 and/or at least one of a weight on bit sensor 20, a torque sensor 20, a rotational speed sensor 20, a vibration sensor 20 and a resistivity sensor 20 positioned in the turbine drilling assembly 18 below the upper drill string connector 44.

Also described above is a turbine drilling assembly 18 which can include a turbine drilling motor 14 having an upper drill string connector 44, a sensor 20 positioned in the turbine drilling assembly 18 below the upper drill string connector 44, and a first transmitter 24 which transmits sensor 20 data through a housing 56 of the turbine drilling motor 14.

The first transmitter 24 may transmit the sensor 20 data at approximately 500 to 3000 Hz, or at approximately 1300 to 1500 Hz, through the turbine drilling motor housing 56.

The receiver 26 may be connected to a second transmitter 28 which is used to transmit the sensor 20 data to a remote location. The first transmitter 24 may modulate the sensor 20 data on stress waves transmitted through the turbine drilling motor housing 56.

The sensor 20 may be positioned between: a) bearings 36 which rotatably support a shaft 38 rotated by the turbine drilling motor 14, and b) a bent housing 22 of the turbine drilling assembly 18; between the turbine drilling motor 14 and both of: a) bearings 36 which rotatably support a shaft 38 rotated by the turbine drilling motor 14, and b) a bent housing 22 of the turbine drilling assembly 18; between a bent housing 22 and a lower drill bit connector 40 of the turbine drilling assembly 18; or in a bearing assembly 32 which rotatably supports a shaft 38 rotated by the turbine drilling motor 14.

The sensor 20 may be mounted to an internal mandrel 46 of the bearing assembly 32.

A bent housing 22 may be positioned between the sensor 20 and bearings 36 which rotatably support a shaft 38 rotated by the turbine drilling motor 14.

The sensor 20 may comprise a gamma radiation sensor, an inclination sensor, a weight on bit sensor, a torque sensor, a rotational speed sensor, a vibration sensor and/or a resistivity sensor.

Although various examples have been described above, with each example having certain features, it should be understood that it is not necessary for a particular feature of one example to be used exclusively with that example.

Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A turbine drilling assembly, comprising:

a turbine drilling motor;

a bearing assembly positioned downhole from the turbine drilling motor;

a bent housing positioned downhole from the bearing assembly;

an inclination sensor located within a sensor housing positioned in the turbine drilling assembly between the turbine drilling motor and the bearing assembly, wherein the inclination sensor is isolated from the well fluid and pressure; and a first transmitter which acoustically transmits inclination data via stress waves through a body of a housing of the turbine drilling motor at approximately 1300 to 1500 Hertz.

2. The turbine drilling assembly of claim 1, wherein the turbine drilling motor is connected between the first transmitter and a receiver.

3. The turbine drilling assembly of claim 2, wherein the receiver is connected to a second transmitter which transmits the inclination data to a remote location.

4. The turbine drilling assembly of claim 1, further comprising a gamma radiation sensor positioned in the sensor housing.

5. The turbine drilling assembly of claim 1, further comprising at least one of the following sensors positioned in the sensor housing: a weight on bit sensor, a torque sensor, a rotational speed sensor, a vibration sensor and a resistivity sensor.

6. A turbine drilling assembly, comprising:

a turbine drilling motor;

a bearing assembly positioned downhole from the turbine drilling motor;

a bent housing;

a sensor located within a sensor housing positioned in the turbine drilling assembly between the turbine drilling motor and the bearing assembly, wherein the sensor is isolated from the well fluid and pressure; and a first transmitter which acoustically transmits sensor data via stress waves through a body of a housing of the turbine drilling motor at approximately 1300 to 1500 Hertz.

7. The turbine drilling assembly of claim 6, wherein the turbine drilling motor is connected between the first transmitter and a receiver.

8. The turbine drilling assembly of claim 7, wherein the receiver is connected to a second transmitter which transmits the sensor data to a remote location.

9. The turbine drilling assembly of claim 6, wherein the sensor comprises a gamma radiation sensor.

10. The turbine drilling assembly of claim 6, wherein the sensor comprises an inclination sensor.

11. The turbine drilling assembly of claim 6, wherein the sensor comprises at least one of: a weight on bit sensor, a torque sensor, a rotational speed sensor, a vibration sensor and a resistivity sensor.

* * * * *